US009622601B2

(12) United States Patent
Krake et al.

(10) Patent No.: US 9,622,601 B2
(45) Date of Patent: Apr. 18, 2017

(54) METHOD AND APPARATUS FOR HANGING SHEET MATERIAL

(71) Applicant: UNDER THE ROOF DECORATING INC., Calgary (CA)

(72) Inventors: Kelly R. Krake, Calgary (CA); Liette Tousignant, Calgary (CA); Michael Kurtz, Calgary (CA)

(73) Assignee: UNDER THE ROOF DECORATING INC., Calgary, Alberta (CA)

( * ) Notice: Subject to any disclaimer, the term of this patent is extended or adjusted under 35 U.S.C. 154(b) by 65 days.

(21) Appl. No.: 14/691,621

(22) Filed: Apr. 21, 2015

(65) Prior Publication Data

US 2016/0309927 A1 Oct. 27, 2016

(51) Int. Cl.

| | |
|---|---|
| ***A47G 1/17*** | (2006.01) |
| ***A47G 1/16*** | (2006.01) |
| ***G09F 7/18*** | (2006.01) |
| ***G09F 17/00*** | (2006.01) |
| ***G09F 7/04*** | (2006.01) |

(52) U.S. Cl.

CPC ..... *A47G 1/17* (2013.01); *A47G 1/1606* (2013.01); *G09F 7/04* (2013.01); *G09F 7/18* (2013.01); *G09F 17/00* (2013.01); *G09F 2007/1852* (2013.01)

(58) Field of Classification Search

CPC A47G 1/17; A47G 1/1606; G09F 2007/1852; B43M 15/00

See application file for complete search history.

(56) References Cited

U.S. PATENT DOCUMENTS

| | | | | |
|---|---|---|---|---|
| 3,456,373 | A * | 7/1969 | Epton | G09F 7/04 40/124 |
| 5,495,686 | A * | 3/1996 | Millard | G09F 7/04 40/621 |
| 6,775,935 | B1 * | 8/2004 | Cohen | G09F 7/04 40/600 |
| 2004/0231212 | A1 * | 11/2004 | Roche | B32B 3/06 40/600 |
| 2015/0342372 | A1 * | 12/2015 | Chafe | A47G 1/1606 40/711 |

* cited by examiner

*Primary Examiner* — Gary Hoge
(74) *Attorney, Agent, or Firm* — Sand & Sebolt

(57) ABSTRACT

A sheet hanging device is configured to attach a sheet of material (e.g., a poster) to a substrate (e.g., a wall) without causing any damage to the sheet or the substrate. The sheet hanging device includes a magnet and a metal member disc. The metal member disc is releasably attached to the substrate via adhesive. The magnet is carried by body member, and may be attached to an insert. The sheet is secured between the magnet and the metal disc as the two are brought together to create an attraction therebetween.

20 Claims, 3 Drawing Sheets

METHOD AND APPARATUS FOR HANGING SHEET MATERIAL

BACKGROUND OF THE INVENTION

Technical Field

The present invention relates generally to the field of displaying information. More particularly, the present invention relates to hanging sheet material on a substrate. Specifically, the present invention relates to hanging a poster on a wall without causing any damage to the wall or the poster.

Background Information

Posters are useful items to display information and are ordinarily hung on a wall. To attach a poster to the wall, a point of a thumbtack or a pushpin pierces the poster sheet and pierces the wall. However, this piercing action damages the poster and the wall. The point forms and aperture in the poster and creates a hole in the wall.

Damaging posters and walls is undesirable. Some posters may be collectors items that decrease in value when altered from their original state (i.e., pierced by a thumbtack is considered an undesirable alteration). Further, damaging a wall is undesirable because repairing pierced holes requires time, effort, and money; or may be unpermitted in some rental properties.

SUMMARY

Issues continue to exist with attaching sheet material (i.e., a poster) to a substrate (i.e., a wall). Namely, a system or device is needed that allows a poster to hang on a wall without damaging the poster or the wall. The present invention addresses these and other issues.

In one aspect, an embodiment of the invention may provide a sheet hanging device comprising: a magnet; a metal member attractable to the magnet including first and second sides, wherein the magnet and metal member repeatably attach and detach to one another securing a sheet of material therebetween without damaging or piercing the sheet material.

In another aspect, an embodiment of the invention may provide, in combination, a poster for hanging on a wall including a outwardly facing first surface opposite a wall facing second surface and a plurality of sheet hanging devices, each sheet hanging device comprising: a first unit contacting the first surface of the poster; a second unit contacting the second surface of the poster and the wall, an attraction between the first and second unit to secure the poster therebetween.

In another aspect, an embodiment of the invention may provide a method of securing a sheet member to a substrate comprising the steps of: attaching a first attraction unit to a substrate with a releasable adhesive that does not cause any damage to the substrate when released, a first surface on the first attraction unit facing away from the substrate when the first unit is attached to the substrate; positioning sheet material over first surface; and approaching a second attraction unit towards the first attraction unit, wherein as the two units are brought together, a magnet force draws the two units together to secure the sheet between the first and second attraction units, wherein the securement between the first and second attraction units causes no damage to the sheet.

In another aspect, the invention may provide a sheet hanging device that is configured to attach a sheet of material (e.g., a poster) to a substrate (e.g., a wall) without causing any damage to the sheet or the substrate. The sheet hanging device includes a magnet and a metal member disc. The metal member disc is releasably attached to the substrate via adhesive. The magnet is carried by a body member, and may be attached to an insert. The sheet is secured between the magnet and the metal disc as the two are brought together to create an attraction therebetween.

BRIEF DESCRIPTION OF THE SEVERAL VIEWS OF THE DRAWINGS

A sample embodiment of the invention is set forth in the following description, is shown in the drawings and is particularly and distinctly pointed out and set forth in the appended claims. The accompanying drawings, which are fully incorporated herein and constitute a part of the specification, illustrate various examples, methods, and other example embodiments of various aspects of the invention. It will be appreciated that the illustrated element boundaries (e.g., boxes, groups of boxes, or other shapes) in the figures represent one example of the boundaries. One of ordinary skill in the art will appreciate that in some examples one element may be designed as multiple elements or that multiple elements may be designed as one element. In some examples, an element shown as an internal component of another element may be implemented as an external component and vice versa. Furthermore, elements may not be drawn to scale.

Similar numbers refer to similar parts throughout the drawings.

DETAILED DESCRIPTION

A sheet hanging device is generally depicted throughout FIGS. 1-5 and is shown generally at 10. Sheet hanging device 10 includes a first end 12 spaced opposite a second end 14, defining a longitudinal direction therebetween extending along a longitudinal center line 16. Sheet hanging device 10 is configured to releaseably secure sheet material, such as a poster, to a substrate, such as a wall, without causing any damage to the wall or the sheet material.

Figure 2A:
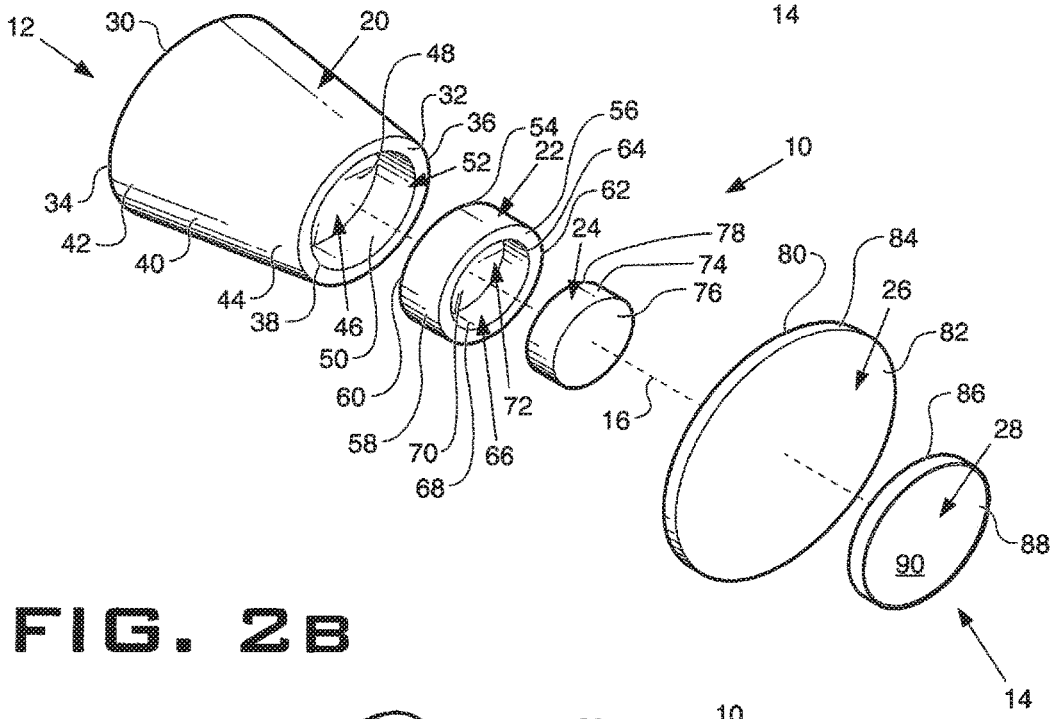
FIG. 2A is an exploded perspective view of the sheet hanging device.

As depicted in FIG. 2A, sheet hanging device 10 includes a body member 20, an insert 22, a magnet 24, a metal member 26, and an adhesive layer member 28.

Figure 1:
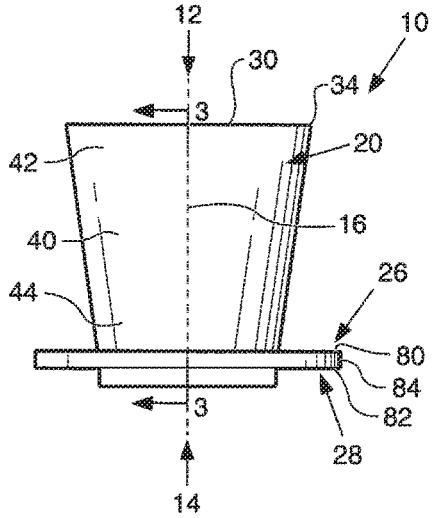
FIG. 1 is a side elevation view of a sheet hanging device of the present invention depicted in an assembled position.

Body member 20 includes a first surface 30 spaced opposite a second surface 32. First surface 30 is generally planar when viewed from the side and faces first end 12. When viewed from above, first surface 30 is generally circular and defined by an outer circumferential edge 34 and is a generally continuous surface across the entirety of first surface 30. Circumferential outer edge 34 is concentric about longitudinal center line 16. First surface 30 generally intersects longitudinal center line 16 in a perpendicular manner when viewed from the side (FIG. 1). Inasmuch as first surface 30 is generally circular, it has a diameter measured from each side of outer circumferential edge 34 through center line 16, wherein one exemplary embodiment provides the diameter of first surface 30 in a range from about 0.5 to about 1". More particularly, one embodiment provides a diameter of first surface 30 of ¾".

Second surface 32 is a ring-like configuration bound by an outer circumferential edge 36 and an inner circumferential edge 38. Surface 32 is defined between circumferential edges 36, 38 and faces second end 14. The plane on which second surface 32 lies perpendicularly intersects longitudinal center line 16 and is concentric thereabout. The width of second surface 32 is uniform measured from outer edge 36 to inner edge 38 and in one exemplary embodiment is in a range from about 0.03" to about 0.1". More particularly, the shown embodiment of FIG. 2A depicts a second surface 32 with a width of about 0.05". The overall diameter of second surface 32 measured from outer circumferential edge 36 through center line 16 is about ½", but may be in a range from about ¼" to about ¾".

A frustoconical sidewall 40 extends from first surface 30 to second surface 32. Frustoconical sidewall 40 forms a rigid connection with circumferential edge 34 and a rigid connection with circumferential edge 36. When viewed form the side, frustoconical sidewall 40 tapers inwardly towards longitudinal center line as side wall 40 approaches second end 14. A first or upper region 42 of a frustoconical 40 has a diameter larger than a second region 44 on sidewall 40. Frustoconical sidewall 40 is concentric about longitudinal center line 16. Sidewall 40 is a continuous surface facing outwardly away from longitudinal center line in a radial manner.

Additionally, it is to be understood that while the frustoconical wall 40 is depicted herein, body member 20 may take on a variety of shapes in keeping with various advantages and aspects of the present invention.

A cylindrical recess 46 is formed near second surface 32 of body member 20. Recess 46 is defined by inner circumferential edge 38, a top recess wall 48, and a cylindrical recess wall 50 extending from a rigid connection with top wall 48 longitudinally to a rigid connection with circumferential edge 38. Top wall 48 is generally circular when viewed from below and perpendicularly intersects longitudinal center line 16. Cylindrical wall 50 is concentric about longitudinal center line 16 and has a longitudinal width of approximately ¼". Circumferential edge 38 defines a recess opening 52 that is open communication with recess 46.

Insert 22 is received within recess 46 when device 10 is in an assembled position. Insert 22 includes a first surface 54 spaced opposite a second surface 56 with a cylindrical sidewall 58 extending therebetween. First surface 54 is a planar surface perpendicularly intersecting center line 16 with an outer circumferential edge 60 defining a generally circular surface when viewed from above. First surface 54 is shaped complimentary to circular recess wall 48 and in a particular embodiment, the dimensions of surface 54 and wall 48 are complimentary permitting frictional interference fit when device 10 is in the assembled position. Diameter measured from outer circumferential edge 60 is similar to diameter of inner circumferential edge 38. In one exemplary embodiment, diameter of outer circumferential edge 60 measured through center line 16 is in a range from about 0.3" to about 0.5". In one particular embodiment, the diameter of outer circumferential edge 60 measured through center line 16 is 0.4". Cylindrical side wall 58 extends from a rigid connection with edge 60 on top surface 54 towards a rigid connection with an outer circumferential edge 62 bounding second surface 56. Second surface 56 is also bound by an inner circumferential edge 64. Inner circumferential edge 64 defines a magnet opening 66. An inner cylindrical wall 68 extends towards first surface 54 from inner edge 64 to a top wall 70. Cylindrical wall 68 and top wall 70 form a magnet recess 72 in communication with magnet opening 66.

Magnet 24 is a general disc-like member, or a round plinth, comprising a magnetic material that produces a magnetic field. The magnetic field emanating from magnet 24 allows magnet 24 to be considered magnetized as a permanent magnet such that it creates its own persistent magnetic field. In one exemplary embodiment, magnet 24 is made from Ferro-magnetic material that may comprise Iron, Nickel, Cobalt, or some rare earth metals such as Lodestone. It is further contemplated that if Ferro-magnetic materials are used to create magnet 24, they may be "soft," such as annealed iron, however, they are preferably "hard" Ferro-magnetic materials as one having ordinary skill in the art would understand. Hard Ferro-magnetic materials are difficult to demagnetize and have a high level of coercivity. Further, it is contemplated that magnet 24 may be a rare earth magnet of the Neodymium-type. Magnet 24 as a Neodymium rare earth magnet is made from Neodymium, Iron, and Boron. This is advantageous inasmuch as Neodymium magnets have a high magnetic strength field and have a high coercivity, but also include a low curie temperature. Magnet 24 includes a first surface 74 spaced opposite a second surface 76 with a cylindrical sidewall 78 extending therebetween. Top surface 74 is planar and intersects center line 16 perpendicularly and is concentric about canter line 16. Magnet 24 is preferably uniform in thickness from first surface 74 to bottom surface 76. The diameter of magnet 24 measured through center line 16 is similar to the diameter of inner edge 64 on insert 22. Magnet 24 fits within, and is received by, recess 72 on insert 22. Preferably, there is a frictional interference fit between cylindrical sidewall 78 on magnet 24 and inner sidewall 68 on insert 22. Top surface 74 is closely adjacent top wall 70 on insert 22. The length of sidewall 78 is substantially similar to the length of inner cylindrical sidewall 68 such that second surface 76 is flush with second surface 56 when viewed in cross section. Further, the length of cylindrical sidewall 58 on insert 22 is similar to inner cylindrical sidewall 50 length on body member 20, such that when insert 22 is positioned within recess 46, second surface 32 is flush with second surface 56 and is flush with second surface 76 (see FIG. 2B). Stated otherwise, the magnet second surface 76 is aligned coplanar with the second surface 32 of the body member 20 defining a poster or sheet engaging surface 96.

Metal member 26 is generally disc-like and includes a first surface 80 spaced apart and facing opposite from a second surface 82 and a cylindrical sidewall 84 extending therebetween. First surface 80 faces first end 12 and second surface 82 faces second end 14. Further, second surface 82 is configured to face a substrate material, or a wall, when device 10 is in use hanging a sheet of material on the wall. First surface 80 faces first end 12 and is also configured to face the rear side of a poster or a hanging sheet of material when device 10 is in use. Disc member 26 is constructed from a metal material designed to attract with magnet 24, that creates a releaseable bond or attraction that may be repeatedly attached and detached as one having ordinary skill in the art would understand. Metal disc member 26 includes an outer diameter measured through center line 16 about which disc member 26 is concentric. The diameter of metal disc member 26 in one exemplary embodiment is in a range from about ¾" of an inch to about 1.25". In one particular embodiment, metal disc 26 has a diameter of 1".

Adhesive or adhering member 28 includes a first surface 86 spaced opposite a second surface 88 covered by a film 90. First surface 86 of adhesive member 28 is substantially covered in an adhesive layer attaching member 28 to second surface 82 of disc 26. When device 10 is sold commercially, it is contemplated that adhesive member 28 will be secured to second surface 82 of metal disc 26 by the manufacturer. An adhesive layer exists between second surface 88 and film layer 90. Film layer 90 operates as a protective barrier that is selectively removed by an end user allowing the user to attach member 26 via adhesive member 28 and the adhesive layer on second surface 88 to a substrate when desired. Film 90 is a peelable film that releases contact with the adhesive layer on second surface 88 and may be repeatedly attached and detached as desired. In one exemplary embodiment, adhesive member 28 is a pressure sensitive adhesive, which is also known as a self-stick adhesive, which forms a bond when pressure is applied to marry the adhesive with a substrate such as the wall. In a preferred embodiment, the adhesive used with device 10 does not need a solvent, heat, or water for activation. The body of adhesible member 28 may be constructed from various styrene block copolymers with unsaturated polydiene blocks in the elastomer block. This elastomer block allows for adhesive member 28 to be stretchable and peelable, if desired, permitting easy removal from a wall substrate without causing any damage to the wall.

Figure 2B:
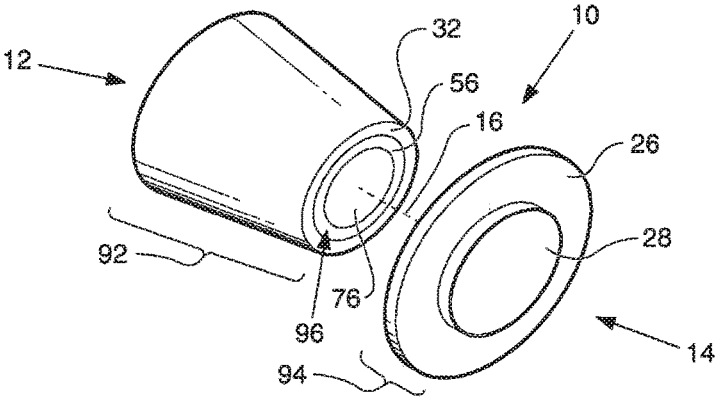
FIG. 2B is a partially exploded perspective view of the sheet hanging device depicting a first attraction unit and a second attraction unit.

As depicted in FIG. 2B, device 10 includes a first attraction unit 92 and a second attraction unit 94 in a semi-assembled position. First unit 92 defines first end 12 and includes body member 20, insert 22, and magnet 24. Magnet 24 is positioned within recess 72. Insert 22, carrying magnet 24, is positioned within recess 46. Thus, the constructed first unit 92 forms a poster sheet engaging surface 96 that is made up of second surface 32, second surface 56, and second surface 76 of the body, insert, and magnet, respectively. Sheet engaging surface 96 is substantially planar when viewed from the side such that the plane formed by the second surfaces 32, 56, and 76 perpendicularly intersects the longitudinal center line 16. With continued reference to FIG. 2B, the second unit 94 includes disc member 26 and adhesive member 28. Adhesive member 28 includes an adhesive layer on first surface 86 adhering member 28 to the second surface 82 of metal disc member 26. Further, it is noteworthy that second unit 94 defines second end 14.

Figure 3:
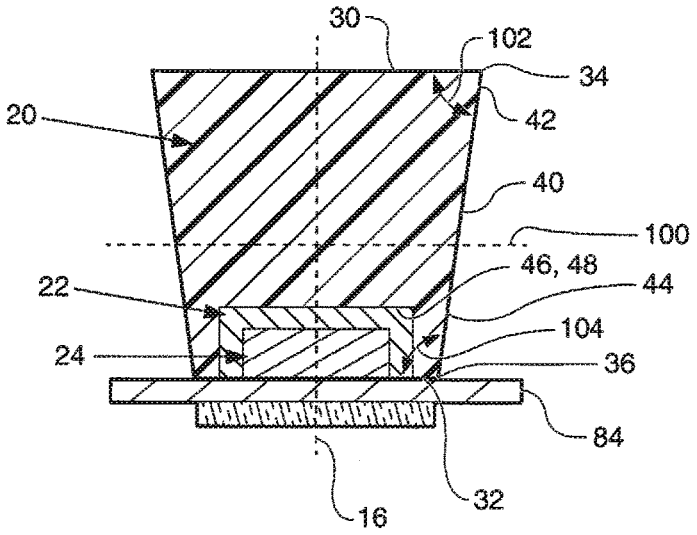
FIG. 3 is a cross section taken along line 3-3 in FIG. 1.

As depicted in the cross section FIG. 3, body 20 is a monolithic member constructed of uniform material from first surface 30 to second surface 32. A middle radial plane 100 perpendicularly intersects longitudinal center line 16 at the midpoint between first surface 30 and second surface 32. Surface 30 and surface 32 are each parallel and offset a distance from radially extending middle plane 100. Top recessed wall 48 defining recess 46 is entirely below middle plane 100. While this configuration represents that the recess 46 extends only a short distance into monolithic body member 20, it is clearly understood that a recess 46, having a deeper depth such that top recess wall 48 may be above midline 100, is entirely possible.

The rigid connection at edge 34 between upper region 42 of frustoconical wall 40 and top surface 30 forms an acute angle 102 within member body 20. Acute angle 102 is positioned above radial middle line 100 when viewed from the side in cross section. An obtuse angle 104 is defined between the rigid connection at edge 36 between lower region 44 of frustoconical sidewall 40 to second surface 32. The obtuse angle is formed within monolithic body member 20 below midline 100.

Figure 4:
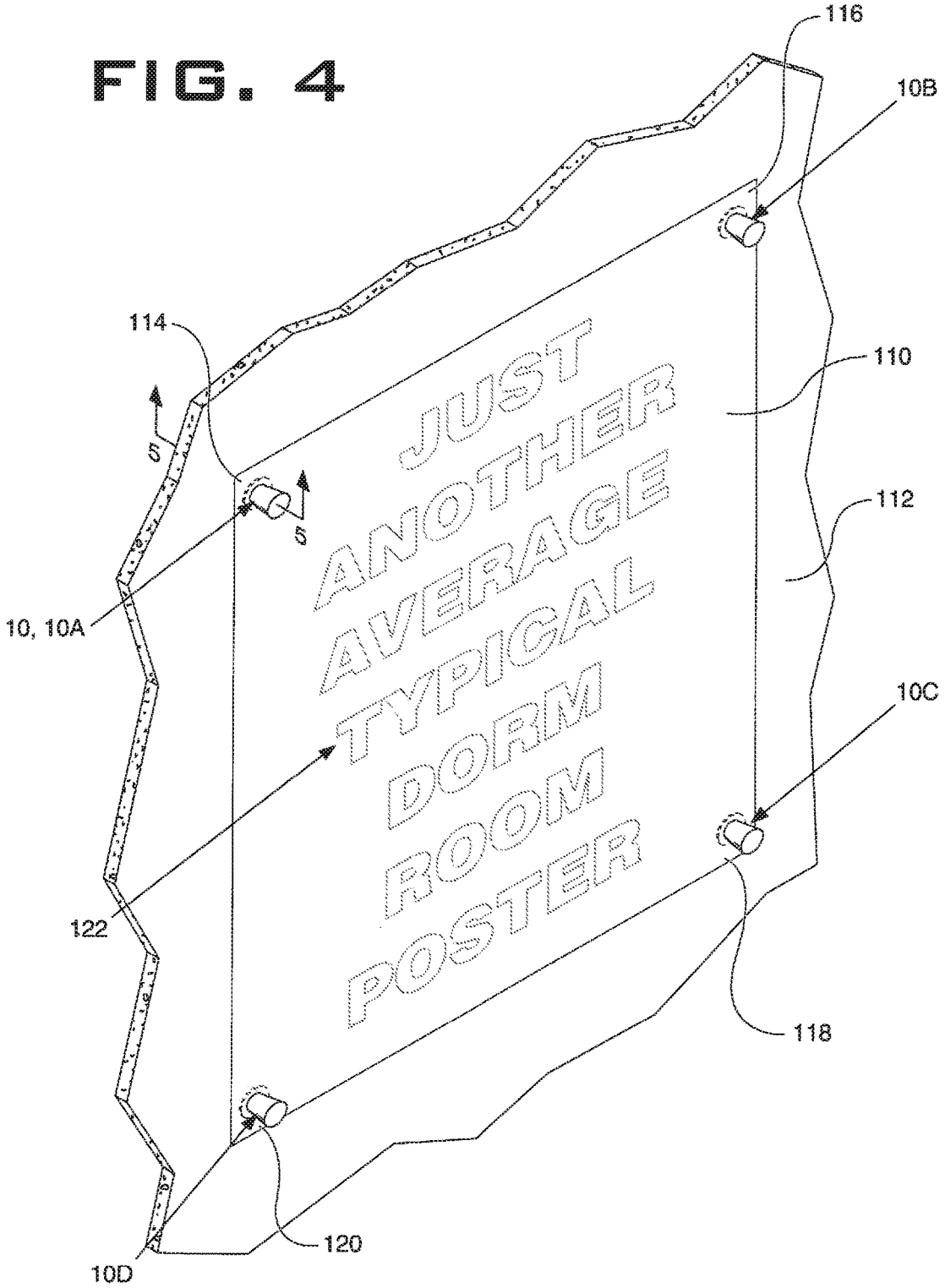
FIG. 4 is a environmental perspective view depicting the sheet hanging device of the present invention attaching a poster to a wall without causing any damage to the poster or the wall.

As depicted in FIG. 4, the sheet hanging device 10 is configured to hang a poster, or other sheet material 110, to a wall or substrate 112. In the particular example shown in FIG. 4, a first sheet hanging device 10A secures poster 110 to substrate wall 112 near a first corner 114. A second sheet hanging device 10B secures poster 110 to wall 112 near a second corner 116. Corners 114 and 116 on poster 110 are the upper left and right corners of the poster respectively. In one embodiment, it is contemplated that the present invention can operate with a single sheet hanging device 10. However, as shown in FIG. 4, it is understood that a poster may be hung from the top left and top right corner 114, 116 respectively with a first sheet hanging device 10A and a second sheet hanging device 10B. Further, additional embodiments may provide a third sheet hanging device 10C securing a bottom right corner 118 of poster 110 to wall 112 and a fourth sheet hanging device 10D securing a bottom left corner 120 of poster 110 to wall 112. Poster 110 may be pre-printed with printed matter 122 as one having ordinary skill in the art would understand. The side of poster 110 with printed matter 122 is considered the outwardly facing surface of poster 110 and faces in the same direction as top surface 30 on body member 20. A back surface of poster 110 faces wall 112 which is oriented in the same direction as sheet engaging surface 96. Devices 10A-10D are the same as device 10 detailed above.

Figure 5:
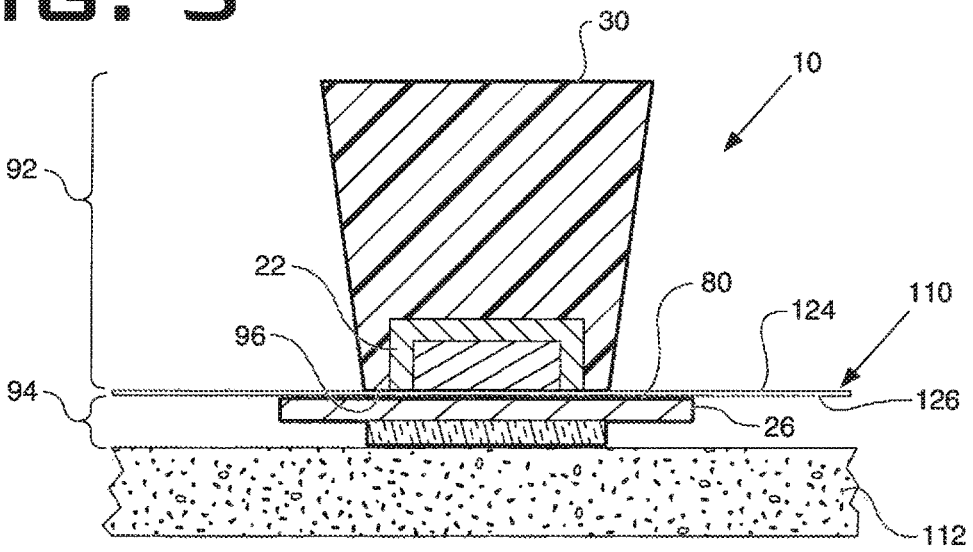
FIG. 5 is a cross section taken along line 5-5 in FIG. 4.

As depicted in FIG. 5, the outwardly facing first surface 124 of poster 110 faces the same direction as first surface 30. FIG. 5 depicts the direction as shown vertically upwards however, when sheet hanging device 10 is hung on a wall, the direction will be away from wall 112. The rear surface 126 of poster 110 faces wall 112. In the assembled position, the combination of the sheet hanging device 10 and the poster 110, and wall 112, causes poster sheet engaging surface 96 to contact the first surface 124 of poster 110. First surface 80 of metal disc 26 contacts the back side surface 126 of poster 110. Magnet 24 establishes a magnetic attraction with metal disc 26 to secure poster 110 between first unit 92 and second unit 94. First unit 92 may be repeatedly attached and detached from second unit 94 secured to wall 112. This allows for adjustability of poster 110.

In accordance with an aspect of the present invention, sheet hanging device 10 provides a new and useful way to hang poster 110 on a wall 112 without causing and damage to wall 112 or poster 110. Prior art devices, such as thumbtacks or pushpins, required a needle to pierce the poster 110 material leaving a hole therethrough in order to hang poster 110 on a wall 112. Further, the conventional thumbtacks also needed to pierce the substrate, or wall 112, leaving a hole therein as well. The adhesive member 28 of the present invention releasably adheres to wall 112 in a manner that does not pierce wall 112 in any way or leave any other damage or residue in the event adhesive member 28 is peeled off. Additionally, the connection of first unit 92 and second unit 94 securing poster material 110 therebetween, allows a user to hang poster 110 without piercing the sheet material of poster 110. This is advantageous as some posters may be collector's items or sentimental to the owner and the other does not want them ruined by piercing them with a needle near the corners as would occur with an ordinary thumbtack or pushpin.

In accordance with another aspect of the present invention, the metal member 26 is attractable to the magnet 24, wherein the magnet 24 and metal member 26 repeatably couple and detach to one another, and when the magnet and metal member are coupled, the sheet hanging device is adapted to secure a sheet of material between the magnet and metal member without damaging or piercing the sheet material (e.g., poster 110).

In operation, a user will peel the film 90 away from adhesive member 28 and secure second unit 94 to wall 112 by firmly applying pressure longitudinally along center line 16. Pressure sensitive adhesive on second surface 88 of adhesive member 28 adheres to the wall securing metal disc 26 to wall 112. The operator will then position the rear surface 126 of poster material 110 closely adjacent first surface 80 on disc member 26. Attraction unit 92 is then guided towards metal disc 26 underneath poster 110. As the first attraction unit 92 approaches metal disc 26, magnet 24 creates an attraction between first unit 92 and second attraction unit 94. The magnet will releasably secure and hold poster 110 between first unit 92 and second unit 94.

To release the securement of poster 110 between unit 92 and unit 94, use grasps member body 20, pulling magnet 24 carried by member body 20 in a direction away from second unit 94. Poster material 110 may then be removed from its position adjacent disc 26 and adhesive member 28 may be peeled away from wall 112 without leaving any residue, marks, or other evidence of previous device 10 placement(s).

Additional embodiments of the present invention are contemplated by the inventors. For example, magnet 24 has been described here as being a part of first unit 92. However, it is entirely possible that the magnet is part of second unit 94 and a metal disc or slug is a part of first unit 92 to create the magnetic attraction between first unit 92 and second unit 94. Further, while the monolithic body member 20 has been described as a generally frustoconical member, other shapes are entirely possible that would be aesthetically appealing to an end user. Additionally, other adhesives may be used throughout the device to secure certain members together. While insert 22 has been described herein as fit within recess 46 of member 20 by frictional interference fit to secure insert therein, clearly adhesives may be used to assist in the securement of insert 22 to body member 20. Similarly the magnet 24 may be adhered within magnet recess 72 of insert 22 as opposed to the frictional interference fit described above.

Additionally, another example contemplated by the present invention may include a tack member (i.e., a pin) extending from second surface 82 of disc 26 in lieu of adhesive 28. The pin may act like a thumb tack to pierce wall substrate 112. While this may cause some minimally invasive damage to the wall, the poster 110 remains unharmed.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration set out herein are an example and the invention is not limited to the exact details shown or described.

What is claimed:

1. A sheet hanging device comprising:

a magnet;

a metal member attractable to the magnet including first and second sides, wherein the magnet and metal member repeatably couple and detach to one another, and when the magnet and metal member are coupled, the sheet hanging device is adapted to secure a sheet of material between the magnet and metal member without damaging or piercing the sheet material;

a body member including first and second surfaces, the first surface facing the same direction as the first side of the metal member, the second surface of the body member facing the same direction as the second side of the metal member;

wherein the magnet is carried by the body member;

an outer edge bounding the second surface of the body member;

an inner edge bounding the second surface of the body member defining an opening;

an inner sidewall extending towards the first surface from the inner edge defining a recess in communication with the opening;

a top recess wall connected to the inner sidewall bounding the recess; and wherein the magnet is disposed within the recess; and the magnet is secured to an insert within the recess.

2. The sheet hanging device of claim 1, further comprising:

a magnet first surface opposite a magnet second surface, the magnet second surface aligned coplanar with the second surface of the body member defining a poster engaging surface.

3. The sheet hanging device of claim 1, further comprising:

a longitudinal center line extending centrally through the body member;

a radial midline plane perpendicularly intersecting the centerline midway between the first and second surface of the body member; and wherein the top recess wall is below the radial midline plane.

4. The sheet hanging device of claim 1, further comprising:

a first diameter associated with the first surface;

a second diameter associated with the second surface; and a frustoconical sidewall extending between the first surface and the second surface.

5. The sheet hanging device of claim 4, wherein the first diameter is larger than the second diameter and the frustoconical sidewall tapers inwardly towards a longitudinal center line as the sidewall approaches the second surface.

6. The sheet hanging device of claim 4, further comprising:

a diameter associated with the metal member, wherein the metal member diameter is larger than the first diameter of the body member.

7. The sheet hanging device of claim 1, wherein the first surface of the body member is flat and perpendicularly intersects a longitudinal center line.

8. The sheet hanging device of claim 1, further comprising:

an adhesive member adhered to a surface of the metal member adapted to releasably secure the metal member to a substrate without causing any damage to the substrate.

9. The sheet hanging device of claim 1, wherein the body member is a monolithic member constructed from a uniform material, the body member comprising a continuous outer surface.

10. A sheet hanging device comprising:

a magnet;

a metal member attractable to the magnet including first and second sides, wherein the magnet and metal member repeatably couple and detach to one another, and when the magnet and metal member are coupled, the sheet hanging device is adapted to secure a sheet of material between the magnet and metal member without damaging or piercing the sheet of material;

a body member including first and second surfaces, the first surface facing the same direction as the first side of the metal member, the second surface of the body member facing the same direction as the second side of the metal member;

wherein the magnet is carried by the body member;

a recess formed near the second surface of the body member; and an insert disposed with the recess, the insert defining a magnet recess and the magnet disposed within the magnet recess.

11. The sheet hanging device of claim 10, further comprising:

a magnet first surface opposite a magnet second surface, the magnet second surface aligned coplanar with the second surface of the body member defining a poster engaging surface.

12. The sheet hanging device of claim 10, further comprising:

a first diameter associated with the first surface;

a second diameter associated with the second surface; and a frustoconical sidewall extending between the first surface and the second surface.

13. The sheet hanging device of claim 12, wherein the first diameter is larger than the second diameter and the frustoconical sidewall tapers inwardly towards a longitudinal center line as the sidewall approaches the second surface.

14. The sheet hanging device of claim 12, further comprising:

a diameter associated with the metal member, wherein the metal member diameter is larger than the first diameter of the body member.

15. the sheet hanging device of claim 10, wherein the first surface of the body member is flat and perpendicularly intersects a longitudinal center line.

16. A sheet hanging device comprising:

a magnet;

a metal member attractable to the magnet including first and second sides, wherein the magnet and metal member repeatably couple and detach to one another, and when the magnet and metal member are coupled , the sheet hanging device is adapted to secure a sheet of material between the magnet and metal member without damaging or piercing the sheet of material;

a body member including first and second surfaces, the first surface facing the same direction as the first side of the metal member, the second surface of the body member facing the same direction as the second side of the metal member;

wherein the magnet is carried by the body member; and a sheet engaging surface defined by the body member, the magnet, and an insert concentrically aligned about a longitudinal center line.

17. The sheet hanging device of claim 16, wherein the body member is aligned concentrically outermost relative to the insert and the magnet; and wherein the magnet is aligned concentrically innermost relative to the insert and the body member.

18. The sheet hanging device of claim 16, further comprising:

a first diameter associated with the first surface;

a second diameter associated with the second surface; and a frustoconical sidewall extending between the first surface and the second surface.

19. The sheet hanging device of claim 18, wherein the first diameter is larger than the second diameter and the frustoconial sidewall tapers inwardly towards a longitudinal center line as the sidewall approached the second surface.

20. The sheet hanging device of claim 16, wherein the first surface of the body member is flat and perpendicularly intersects a longitudinal center line.

* * * * *